United States Patent [19]

Bland et al.

[11] Patent Number: 4,518,363

[45] Date of Patent: May 21, 1985

[54] VENT ASSEMBLY FOR MARINE PROPULSION DEVICES

[75] Inventors: Gerald F. Bland, Kenosha, Wis.; Donald K. Sullivan, Waukegan, Ill.

[73] Assignee: Outboard Marine Corporation, Waukegan, Ill.

[21] Appl. No.: 570,417

[22] Filed: Jan. 13, 1984

Related U.S. Application Data

[63] Continuation of Ser. No. 349,177, Feb. 16, 1982, abandoned.

[51] Int. Cl.[3] ..... B63H 21/34

[52] U.S. Cl. ..... 440/89; 440/77; 440/900; 114/212

[58] Field of Search ..... 440/76, 77, 88, 89; 114/197, 198, 211, 212; 441/90, 91; 128/201.11; 137/409, 449

[56] References Cited

U.S. PATENT DOCUMENTS

| | | | |
|---|---|---|---|
| 40,279 | 10/1863 | Raymond | 114/197 |
| 1,318,545 | 10/1919 | Dehn | 137/409 |
| 1,694,790 | 12/1928 | Nelson | 440/89 |
| 2,094,499 | 9/1937 | Scavo | 441/91 |
| 2,652,027 | 9/1953 | Coyner | 137/449 |
| 3,054,374 | 9/1962 | Jones et al. | 114/198 |
| 3,745,962 | 7/1973 | Murphy | 440/88 |
| 3,812,813 | 5/1974 | Dickson | 440/89 |
| 4,003,331 | 1/1977 | Brinton | 440/89 |

FOREIGN PATENT DOCUMENTS

| | | | |
|---|---|---|---|
| 83696 | 6/1980 | Japan | 440/900 |
| 57158 | 10/1936 | Norway | 114/197 |

*Primary Examiner*—Trygve M. Blix
*Assistant Examiner*—Jesus D. Sotelo
*Attorney, Agent, or Firm*—Michael, Best & Friedrich

[57] ABSTRACT

The outboard motor includes a powerhead housing defining an engine compartment for an internal combustion engine and a vent assembly for ventilating the engine compartment to the atmosphere. The vent assembly includes a tubular member mounted in an aperture in the housing bottom wall and having an inlet port communicating with the interior of the engine compartment, an outlet communicating with the atmosphere and an interior wall defining a bulbous passage between the inlet and outlet ports. Under normal operating conditions, a buoyant ball valve movably disposed in the bulbous passage is held in an open position by gravity to afford free air flow into and out of the engine compartment. In the event the water rises to a level above the housing bottom wall, the ball valve floats on the water entering through the vent assembly outlet and sealingly engages a valve seating surface to prevent entry of water into the engine compartment.

2 Claims, 3 Drawing Figures

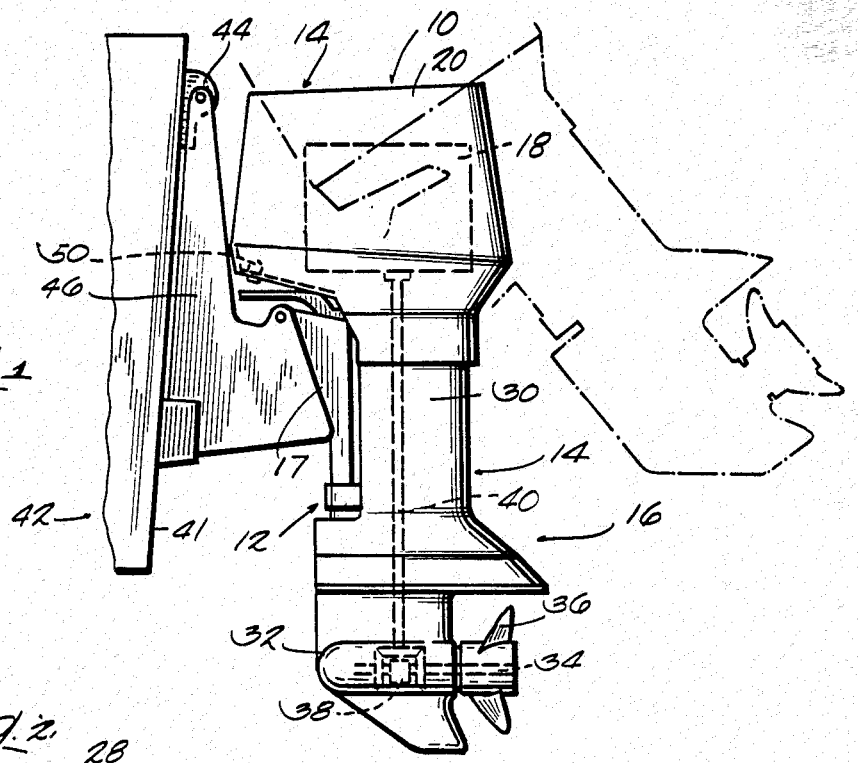
Fig. 1
Fig. 2
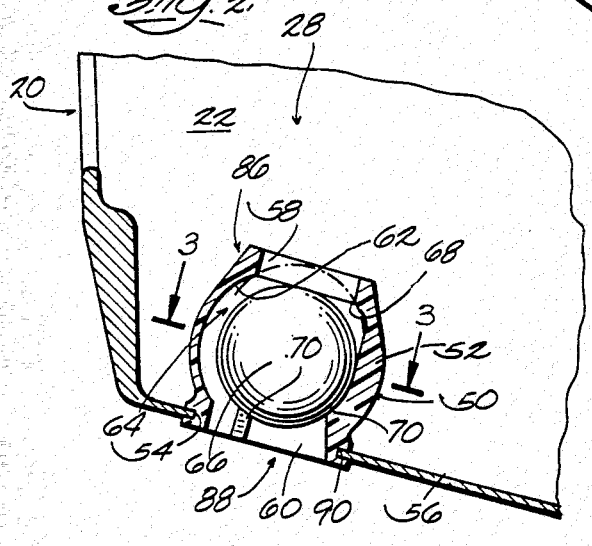
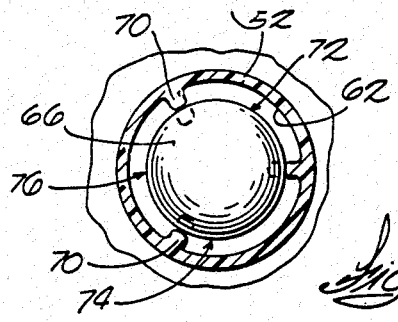
Fig. 3

VENT ASSEMBLY FOR MARINE PROPULSION DEVICES

This application is a continuation of Ser. No. 349,177, filed Feb. 16, 1982, now abandoned.

BACKGROUND OF THE INVENTION

This invention relates to marine propulsion devices and, more particularly, to marine propulsion devices having a powerhead carried aft of the boat transom in both the upright and tilted positions.

Outboard motors typically include a powerhead having a cover or housing defining an engine compartment for an internal combustion engine. This powerhead housing normally includes one or more openings for permitting the intake of combustion air into an engine compartment and/or for venting fluids from the engine compartment. These openings can permit entry of water into the engine compartment during heavy rain or heavy wave conditions. The powerhead housing for outboard motors carried wholly aft of the boat transom usually is somewhat closer to the water. Consequently, there is greater possibility of water entering in the engine compartment through these openings during heavy wave conditions. Means capable of ventilating the engine compartment to the atmosphere, but preventing water from entering the engine compartment under high water conditions, is desirable.

Attention is directed to the following U.S. Patents relating to vent arrangements for applications other than in marine propulsion devices:

| PATENT | U.S. PAT. NO. | ISSUE DATE |
|---|---|---|
| Lombard | 2,528,600 | November 7, 1950 |
| Pfrengle | 3,614,960 | October 26, 1971 |
| Bogdanski | 3,620,240 | November 16, 1971 |
| Dragon et al | 3,662,725 | May 16, 1972 |
| Small wood | 3,736,950 | June 5, 1973 |
| Davis | 3,770,001 | November 6, 1973 |

SUMMARY OF THE INVENTION

The invention provides a marine propulsion device comprising a propulsion assembly including a lower unit having a gear case normally submerged in water and carrying a rotatably mounted propeller, an upper unit including a powerhead housing normally located above the water and defining an engine compartment for an internal combustion engine, and a vent assembly in the powerhead housing for ventilating the engine compartment to the atmosphere. The vent assembly includes means defining a passage having an inlet communicating with the interior of the engine compartment and an outlet communicating with the atmosphere and further includes valve means movably disposed in the passage between the inlet and outlet and operable to permit the egress and ingress of air from and into the engine compartment through the passage when the powerhead housing is above the water and to prevent the ingress of water into the engine compartment in response to the water level rising above the passage outlet.

In one embodiment, the powerhead housing includes a lower wall, the passage-defining means includes an aperture in the powerhead housing lower wall and a tubular member disposed in the aperture and having an inlet port, an outlet port and an interior wall defining a passage between the inlet and the outlet ports. The interior wall of the tubular member includes an annular valve seating surface and a buoyant ball valve member is disposed in the passage and movable therein between an open position wherein the ball valve member is held by gravity away from the valve seating surface and a closed position wherein the valve ball member is moved into sealing engagement with the valve seating surface in response to water entering the outlet port and rising in the passage.

One of the principal features of the invention is the provision of a marine propulsion device including a propulsion assembly having a powerhead housing defining an engine compartment for an internal combustion engine and a vent assembly for ventilating the engine compartment to the atmosphere under normal conditions and for preventing water from entering the engine compartment when the water level is above the lower portion of the powerhead housing.

Another of the principal features of the invention is the provision of such a marine propulsion device including such a vent assembly which can be conveniently assembled and installed.

Other features, aspects and advantages of the invention will become apparent to those skilled in the art upon reviewing the following detailed description, the drawing and the appended claims.

BRIEF DESCRIPTION OF THE DRAWING

FIG. 1 is a side elevetional view of an outboard motor embodying various of the features of the invention, shown mounted on a boat transom.

FIG. 2 is an enlarged, sectional view of the vent assembly and the surrounding components of the outboard motor of FIG. 1 with the propulsion assembly in the operating position.

FIG. 3 is a sectional view taken generally aong line 3—3 in FIG. 2.

Before explaining at least one of the embodiments of the invention in detail, it is to be understood that the invention is not limited in its application to the details of construction and the arrangement of components set forth in the following description or illustrated in the drawings. The invention is capable of other embodiments and of being practiced and carried out in various ways. Also, it is to be understood that the phraseology and terminology employed herein is for the purpose of description and should not be regarded as limiting.

DESCRIPTION OF THE PREFERRED EMBODIMENTS

Illustrated in FIG. 1 is a marine propulsion device in the form of an outboard motor 10 having a propulsion assembly 12 including an upper unit or powerhead 14, a lower unit 16 and a swivel bracket 17.

The powerhead 14 includes an internal combustion engine 18 and a cover or housing 20 defining an engine compartment 22 enclosing the engine 18.

The lower unit 16 is rigidly mounted to the bottom of the powerhead 14 and includes a driveshaft housing 30 and a gear case 32. The gear case 32 is normally submerged in water and supports a rotatable propeller shaft 34 carrying a propeller 36. The gear case 32 houses a suitable reversing transmission 38 which drivingly connects the propeller 34 to a driveshaft 40 extending through the driveshaft housing 30 and drivingly connected to the engine 18.

The lower unit 16 is connected to the swivel bracket 17 for swinging movement about a vertical axis and in a horizontal plane to provide steering control of the propulsion assembly 12. The propulsion assembly 12 is supported from the transom 41 or other supporting member of a boat hull 42 by a transom bracket 44 and a intermediate or stern bracket 46 on which the swivel bracket 17 is mounted. The stern bracket 46 is connected to the transom braket 44 for pivotal or tilting movement of the propulsion assembly 12, including the swivel bracket 17, about a horizontal transverse axis and in a vertical plane between an operating position (illustrated by solid lines in FIG. 1) wherein the gear case 32 and the propeller 36 are fully submerged in the water and a tilted or non-operating position (illustrated by dashed lines in FIG. 1) wherein the gear case 31 and the propeller 36 are raised from the water.

Means for provided in the powerhead housing 20 for ventilating the engine compartment 22 to the atmosphere, but preventing water from entering the engine compartment 22 when the water level rises above the lower portion of the powerhead 14. In the specific construction illustrated, the ventilating means includes a vent assembly 50 including a tubular casing or member 52 mounted in an aperture 54 in a bottom wall 56 of the powerhead housing 20. The tubular member 52 has an inlet port 58 communicating the interior of the engine compartment 22, an outlet port 60 communicating with the atmosphere and an interior wall 62 defining a bulbous main passage 64 between the inlet and outlet ports 58 and 60. The vent assembly 50 also includes a buoyant, spherical or ball valve member 66, made from a light weight synthetic plastic material or the like, disposed in the bulbous portion of the main passage 62 between the inlet and outlet ports 58 and 60.

The ball valve member 66 serves as a float valve to permit the free flow of air into and out of the engine compartment via the main passage 62 when the water level is below the bottom wall 56 of the powerhead housing 20 and to prevent the ingress of water into the engine compartment 22 when the water level rises above the bottom wall 56 of the powerhead housing 20. More specifically, the interior wall 62 of the tubular member 52 includes an annular valve seating surface 68 located in the vicinity of the inlet port 58 and arranged to be sealingly engaged by the ball valve member 66. Extending radially inwardly from the interior wall 62 of the tubular member 52 in the vicinity of the outlet port 60 is a plurality (e.g., 3) of circumferentially-spaced ribs 70 which are arranged to hold the ball valve member 66 in spaced relationship to the interior wall 62 so that air and other gases can flow past the ball valve member 66. That is, when the ball valve member 66 is in engagement with the ribs 70, small flow passages 72, 74 and 76 are defined between the ball valve member 66 and the interior wall 62 as shown in FIG. 3.

When the propulsion assembly 12 is in the operating position and the water level is below the bottom wall 56 of the powerhead housing 20, the ball valve member 66 is held by gravity in the open position against the ribs 70 as illustrated by solid lines in FIG. 2. Air and other gases can flow into and out of the engine compartment through the main passage 64 and the small flow passages 72, 74 and 76 when the ball valve member 66 is in the open position. If the water level rises above the bottom wall 56 of the powerhead housing 20, water enters the outlet port 60 and the buoyant ball valve member 66 floats on the water rising in the passage 64 until it is moved to the closed position in sealing engagement with the seating surface 68 as illustrated by dashed line in FIG. 2.

The tubular member 52 preferably is made from a highly resilient material and has a relatively thin wall, such as in the form of a rubber boot, so as to facilitate stretching of the outlet port end 88 to permit insertion of the ball valve member 66 through the outlet port 60 which has an inside diameter smaller than the outer diameter of the ball valve member 66. The outlet port end 88 of the tubular member 52 includes an external, circumferentially extending groove 90 which receives the rim of the aperture 54, thereby facilitating snap-in mounting of the vent assembly 50 on the lower wall 56 of the powerhead housing 20.

Various of the features of the invention are set forth in the following claims:

We claim:

1. A marine propulsion device comprising a propulsion assembly including a lower unit having a gear case normally submerged in water and carrying a rotatably mounted propeller, an upper unit including a powerhead housing normally located above the water, defining an engine compartment, and including a lower wall having therein an aperture surrounded by a marginal wall portion, an internal combustion engine disposed inside said engine compartment and drivingly connected to said propeller, a tubular member fabricated of resilient material, extending vertically, and including an upper part with an upper port communicating with said engine compartment, a lower part having an outer surface including a circumferentially extending annular groove receiving said marginal wall portion and an inner surface defining a lower port communicating with the atmosphere, said lower part being deformable from a normal size to a collapsed smaller size affording snap-in receipt of said marginal wall portion into said annular groove and to a stretched larger size, and a passage portion intermediate said upper and lower parts and including a valve seat facing downwardly, and a bulbous part below said valve seat, and a buoyant ball valve member disposed in said bulbous part of said passage portion, having a size greater than said normal size and smaller than said stretched larger size to permit insertion of said ball valve member into said bulbous part of said passage portion, and being movable between a lower open position wherein said ball valve member is supported in spaced relation from said valve seat in response to gravitational force, whereby to afford fluid flow between said engine compartment and the atmosphere, and an upper closed position wherein said ball valve member is in sealing engagement with said valve seat in response to water entering said lower port and rising in said passage portion, whereby to prevent water flow into said engine compartment.

2. A marine propulsion device comprising a propulsion assembly including a lower unit having a gear case normally submerged in water and carrying a rotatably mounted propeller, an upper unit including a powerhead housing normally located above the water, defining an engine compartment, and including a lower wall having therein an aperture surrounded by a marginal wall portion, an internal combustion engine disposed inside said engine compartment and drivingly connected to said propeller, and a vent assembly in said powerhead housing for ventilating said engine compartment to the atmosphere, said vent assembly including a tubular member fabricated of resilient material, extending vertically, and including an upper part with a normally open upper port communicating with said engine compartment, a lower part having an outer surface including a circumferentially extending annular groove receiving said marginal wall portion and an inner surface defining a lower port communicating with the atmosphere, said lower part being deformable from a normal size to a collapsed smaller size affording snap-in receipt of said marginal wall portion into said annular groove and to a stretched larger size, and a passage portion intermediate said upper and lower parts and including a valve seat facing downwardly, a bulbous part below said valve seat, and a plurality of circumferentially-spaced, radially inwardly extending ribs which are located below said valve seat, and a buoyant ball valve member disposed in said bulbous part of said passage portion, having a size greater than said normal size and smaller than said stretched larger size to permit insertion of said ball valve member into said bulbous part of said passage portion, and being movable between a lower open position wherein said ball valve member is supported on said ribs in spaced relation from said valve seat in response to gravitational force, whereby to afford fluid flow between said engine compartment and the atmosphere, and an upper closed position wherein said ball valve member is in sealing engagement with said valve seat in response to water entering said lower port and rising in said passage portion, whereby to prevent water flow into said engine compartment.

* * * * *